US006543765B2

(12) United States Patent
Kerpe et al.

(10) Patent No.: US 6,543,765 B2
(45) Date of Patent: Apr. 8, 2003

(54) GUIDING DEVICE OF A MACHINE FOR PROCESSING PLANAR PRINTING MATERIALS

(75) Inventors: Sven Kerpe, Eggenstein-Leopoldshafen (DE); Frank Gunschera, Nussloch (DE); Christian Hieb, Neuhofen (DE); Markus Gerstenberger, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 22 days.

(21) Appl. No.: 09/739,542

(22) Filed: Dec. 15, 2000

(65) Prior Publication Data

US 2001/0006276 A1 Jul. 5, 2001

(30) Foreign Application Priority Data

Dec. 15, 1999 (DE) ..... 199 60 680

(51) Int. Cl.[7] ..... B65H 29/24
(52) U.S. Cl. ..... 271/195; 271/204
(58) Field of Search ..... 271/194, 195, 271/204; 406/86, 87, 88; 226/97

(56) References Cited

U.S. PATENT DOCUMENTS 3,299,535 A * 1/1967 Stull et al. ..... 406/88
3,385,490 A * 5/1968 Malmgren et al. ..... 406/88
5,868,386 A * 2/1999 Stiel et al. ..... 271/195
5,927,203 A * 7/1999 Gieser et al. ..... 271/195
6,279,898 B1 * 8/2001 Stephan ..... 271/195

FOREIGN PATENT DOCUMENTS

DE 3411029 C2 10/1987
DE 4209067 C2 3/1997

OTHER PUBLICATIONS

Japanese Patent Abstract No. 1996 264465 (Shinichi), dated Apr. 28, 1998.

* cited by examiner

*Primary Examiner*—H. Grant Skaggs
(74) *Attorney, Agent, or Firm*—Laurence A. Greenberg; Werner H. Stemer; Gregory L. Mayback

(57) ABSTRACT

A guiding device of a machine for processing planar print carriers, the guiding device having a guide surface, over and beyond which sheets are drawn, during operation, simultaneously with positive guidance by a margin of the sheets, which, respectively, extends in a direction of sheet travel, and having nozzles terminating in the guide surface, for conducting therethrough, during operation, a flow of air for forming an air cushion between the guide surface and the respective sheet, comprising a region with a closed surface located on the guide surface, on the path of the print carrier along the guide surface, said region being disposed opposite a respective margin of a processable one of the print carriers of varying format, the margin extending laterally with respect to the direction of sheet travel.

10 Claims, 2 Drawing Sheets

GUIDING DEVICE OF A MACHINE FOR PROCESSING PLANAR PRINTING MATERIALS

BACKGROUND OF THE INVENTION

Field of the Invention

The invention relates to a guiding device of a machine processing sheet-like print carriers, in particular of a sheet-processing printing machine, the guiding device having a guide surface, over and beyond which sheets are drawn, during operation, simultaneously with positive guidance by a margin of the sheets which, respectively, extends in a direction of sheet travel, and having nozzles terminating in the guide surface, for conducting therethrough, during operation, a flow of air for forming an air cushion between the guide surface and the respective sheet; the invention also related to a machine for processing sheet-like print carriers, which is equipped with a guiding device of the foregoing type.

A guiding device of the type mentioned hereinbefore has become known, for example, from the published German Patent Document DE 42 09 067 C2, which corresponds to pending U.S. patent application Ser. No. 09/699,981. This document considers the problem wherein a sheet, which is drawn over and beyond an air cushion located between the latter and the guide surface, assumes an insufficient suspension or flotation height in jeopardized zones. It has become clear that one of these jeopardized zones is the sheet margins which extend lateral to the direction of travel of the sheets.

In order to ensure a sufficient flotation height in zones of lateral margins of the sheets, it is proposed, in the aforementioned publication, that, according to a first embodiment, blocking bars be arranged on the guide surface along the sheet side edges. According to a second embodiment, lateral blowers are provided, which blow under the outer margins of a respective sheet from the outside. With these embodiments, a build-up of air is generated under the sheet and increases the flotation height of the latter. In both of the aforementioned instances, setting operations are necessary in order to adapt to the format of the print carrier to be processed.

SUMMARY OF THE INVENTION

It is accordingly an object of the invention to provide a guiding device of a machine for processing planar print carriers which is based upon the construction of the guiding device initially mentioned in the introduction hereto, so that, in order to guide sheet-like print carriers of varying format over the guide surface, there is no need for any aids which have to be adjusted in order to adapt to the respective format.

With the foregoing and other objects in view, there is provided, in accordance with one aspect of the invention, a guiding device of a machine for processing planar print carriers, the guiding device having a guide surface, over and beyond which sheets are drawn, during operation, simultaneously with positive guidance by a margin of the sheets, which, respectively, extends in a direction of sheet travel, and having nozzles terminating in the guide surface, for conducting therethrough, during operation, a flow of air for forming an air cushion between the guide surface and the respective sheet, comprising a region with a closed surface located on the guide surface, on the path of the print carrier along the guide surface, the region being disposed opposite a respective margin of a processable one of the print carriers of varying format, the margin extending laterally with respect to the direction of sheet travel.

In accordance with another feature of the invention, the nozzles, when a flow passes through them, during operation, serves for generating flows aligned with the lateral margins of the print carriers, the nozzles being restricted to a region which has, transversely to the direction of sheet travel, an extent lying within an extent which is transverse to the direction of sheet travel and which has a print carrier with a smaller format than a print carrier with the largest processable format.

In accordance with a further feature of the invention, the nozzles, when a flow passes through them, during operation, serves for generating flows oriented perpendicularly to the lateral margins.

In accordance with an added feature of the invention, the nozzles lie within an extent, transverse to the direction of travel of a print carrier having the smallest possible format suitable for processing.

In accordance wit a concomitant aspect of the invention, there is provided a machine for processing planar print carriers, including a guiding device having a guide surface, over and beyond which sheets are drawn, during operation, simultaneously with positive guidance by a margin of the sheets, which, respectively, extends in a direction of sheet travel, and having nozzles terminating in the guide surface, for conducting therethrough, during operation, a flow of air for forming an air cushion between the guide surface and the respective sheet, the guiding device comprising a region with a closed surface located on the guide surface, on the path of the print carrier along the guide surface, the region being disposed opposite a respective margin of a processable one of the print carriers of varying format, the margin extending laterally with respect to the direction of sheet travel.

To achieve the foregoing objectives, on the path of the print carrier along the guide surface, there is provided on the latter a region with a closed surface located opposite a respective margin of the processable print carriers of varying format, the margin being lateral with respect to the direction of travel.

This construction is based upon the recognition that an underpressure is formed in the mouth or outlet regions of nozzles which open into the guide surface and through which a flow passes in order to produce an air cushion between the guide surface and a sheet drawn over and beyond the latter and an overpressure necessary for the suspended or floating guidance of the sheet is built up only at some distance from the respective mouth or outlet region. A construction according to the invention avoids the situation wherein a margin of any one of the processable print carriers of varying format, the margin being lateral with respect to the direction of travel, comes into the range of influence of the underpressure in the mouth or outlet regions of the nozzles.

In order to implement this, however, it is clearly possible to place the nozzles so that, when a format smaller than the maximum possible format is being processed, some of the nozzles are arranged outside the lateral margins of the smaller format.

In a preferred embodiment, there is a provision for nozzles, when a flow passes operationally through them, to generate flows aligned with the lateral margins of the print carriers and to be restricted to a region which has, transversely to the direction of sheet travel, an extent lying within an extent which is transverse to the direction of sheet travel and which has a print carrier with a smaller format than a print carrier with the largest processable format.

A further preferred embodiment provides for the nozzles, when a flow passes operationally through them, to generate flows oriented perpendicularly to the lateral margins.

According to a preferred development, there is provision for the nozzles to lie within an extent, transverse to the direction of sheet travel, of a print carrier having the smallest possible format suitable for processing.

This embodiment combines within it partly production-related and partly functional benefits which go beyond the construction necessary for achieving the objective presented herein.

A preferred restriction of the nozzles to only two nozzle rows within the smallest format requires a comparatively low outlay in terms of construction for supplying the nozzles with blowing or blast air, when compared with supplying conventional nozzles distributed over wide regions of a guide surface. Furthermore, particularly when the nozzles are preferably closely adjacent to one another in each of the nozzle rows, the nozzle orientation that is provided affords a functional advantage inasmuch as a pressure profile below the respective sheet is consequently virtually constant in the direction of sheet travel, so that a pressure profile occurring below a respective sheet gives rise, transversely to the direction of sheet travel, to an effect which is desirable per se, specifically that of stiffening the respective sheet in the direction of travel. This has, however, a steadying effect upon the travel of the sheet along the guide surface.

Other features which are considered as characteristic for the invention are set forth in the appended claims.

Although the invention is illustrated and described herein as embodied in a guiding device of a machine processing planar print carriers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

The explanations herein are based upon a machine for processing planar print carriers which is in the form of a sheet-fed rotary printing machine.

Figure 1:
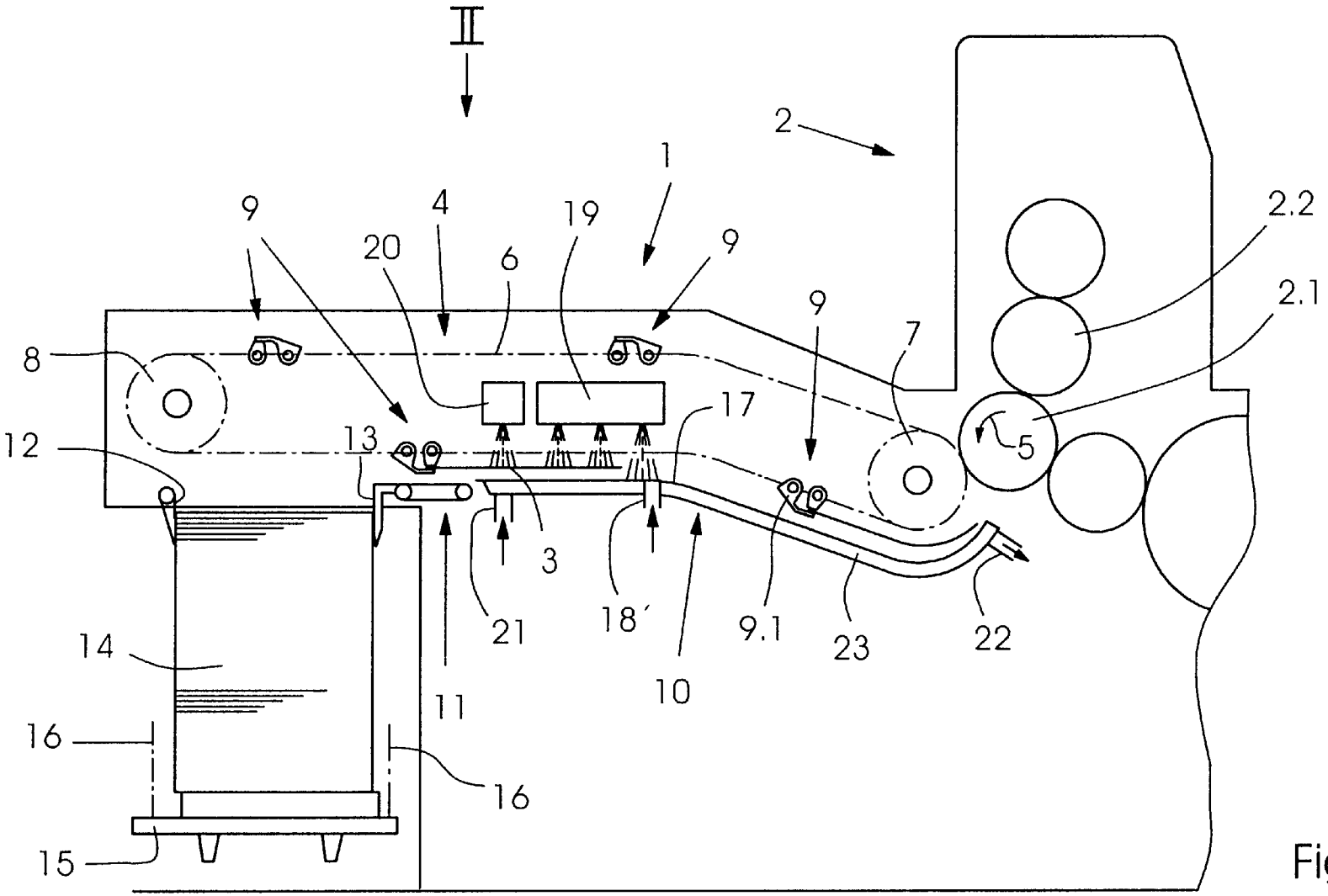
FIG. 1 is a fragmentary diagrammatic side elevational view of a machine for processing planar print carriers, showing a delivery thereof.

Referring now to the drawings and, first, particularly to FIG. 1 thereof, there is shown diagrammatically therein, a last processing station followed by a delivery 1. Such a processing station may be a printing unit or an aftertreatment unit, such as a lacquering unit, for example. In the example at hand, the last processing station is a printing unit 2 operating by the offset method and having an impression cylinder 2.1. The latter guides a respective sheet 3, in a processing direction indicated by an arrow 5 showing the direction of rotation of the impression cylinder 2.1, through a printing nip between the impression cylinder 2.1 and a rubber blanket cylinder 2.2 cooperating therewith, and subsequently transfers it onto a chain conveyor 4 following the opening of grippers arranged on the impression cylinder 2.1 and provided for grasping the sheet 3 at the leading end of that sheet along a gripper margin. The chain conveyor 4 includes two conveyor chains 6, one of which, respectively, rotates, during operation, along a respective side wall of the delivery 1. A respective conveyor chain 6 is looped around one of two synchronously-driven driving sprocket wheels 7, the axes of rotation of which are in alignment with one another and, in the example at hand, is guided, respectively, over a deflecting or reversing sprocket wheel 8 located downline from the driving sprocket wheels 7, as viewed in the processing direction. Gripper systems 9 extend between and are carried by the two conveyor chains 6. The gripper systems 9 have grippers 9.1 which pass through gaps formed between the grippers arranged on the impression cylinder 2.1, simultaneously grasping the gripper margin at the leading end of a respective sheet 3, take over the sheet immediately before the grippers arranged on the impression cylinder 2.1 open, transport the sheet over and beyond a guiding device 10 to a sheet brake 11 and open thereat so as to transfer the sheet 3 onto the sheet brake 11. The latter gives the sheet 3 a depositing speed which is reduced relative to the processing speed and, in turn, releases the sheet after it has attained the depositing speed, so that, finally, a respective sheet 3, that is now slowed down, impinges on leading-edge stops 12 and, after being oriented at these leading-edge stops and at trailing-edge stops 13 located opposite the latter, forms, together with a preceding and/or following sheet 3, a sheet pile 14 which is lowerable by a lifting unit in a manner proportional to the growth of the sheet pile 14. The lifting unit is represented in FIG. 1 by a platform 15 thereof carrying the sheet pile 14, and lifting chains 16 carrying the platform and represented in phantom, i.e., by dot-dash lines.

The conveyor chains 6 are guided along the paths thereof between the driving sprocket wheels 7, on the one hand, and the deflecting or reversing sprocket wheels 8, on the other hand, by chain guide rails which thus define chain paths of strands of the chains 6. In the illustrated example, the sheets 3 are transported by the chain strand which is shown lower in FIG. 1. That section of the chain path through which the chain strand runs is followed by a guide surface 17 which faces the section and is formed on the guiding device 10. A suporting air cushion is preferably formed, during operation, between the guide surface 17 and the sheet 3 which is, respectively, guided beyond the guide surface 17. For this purpose, the guiding device 10 is equipped with blowing air nozzles which terminate in the guide surface 17. Only one of the nozzles representing all of them is reproduced in FIG. 1 and is illustrated symbolically in the form of a connecting piece 18.

In order to prevent the printed sheets 3 in the sheet pile 14 from sticking to one another, a dryer 19 and a powder sprayer 20 are provided along the path of the sheets 3 from the driving sprocket wheels 7 to the sheet brake 11.

In order to avoid excessive heating of the guide surface 17 by the dryer 19, a coolant circuit is integrated in the sheet guiding device 10, as indicated symbolically in FIG. 1 by an inlet connecting piece 21 and-an outlet connecting piece 22 on a coolant tank 23 assigned to the guide surface 17.

Figure 2:
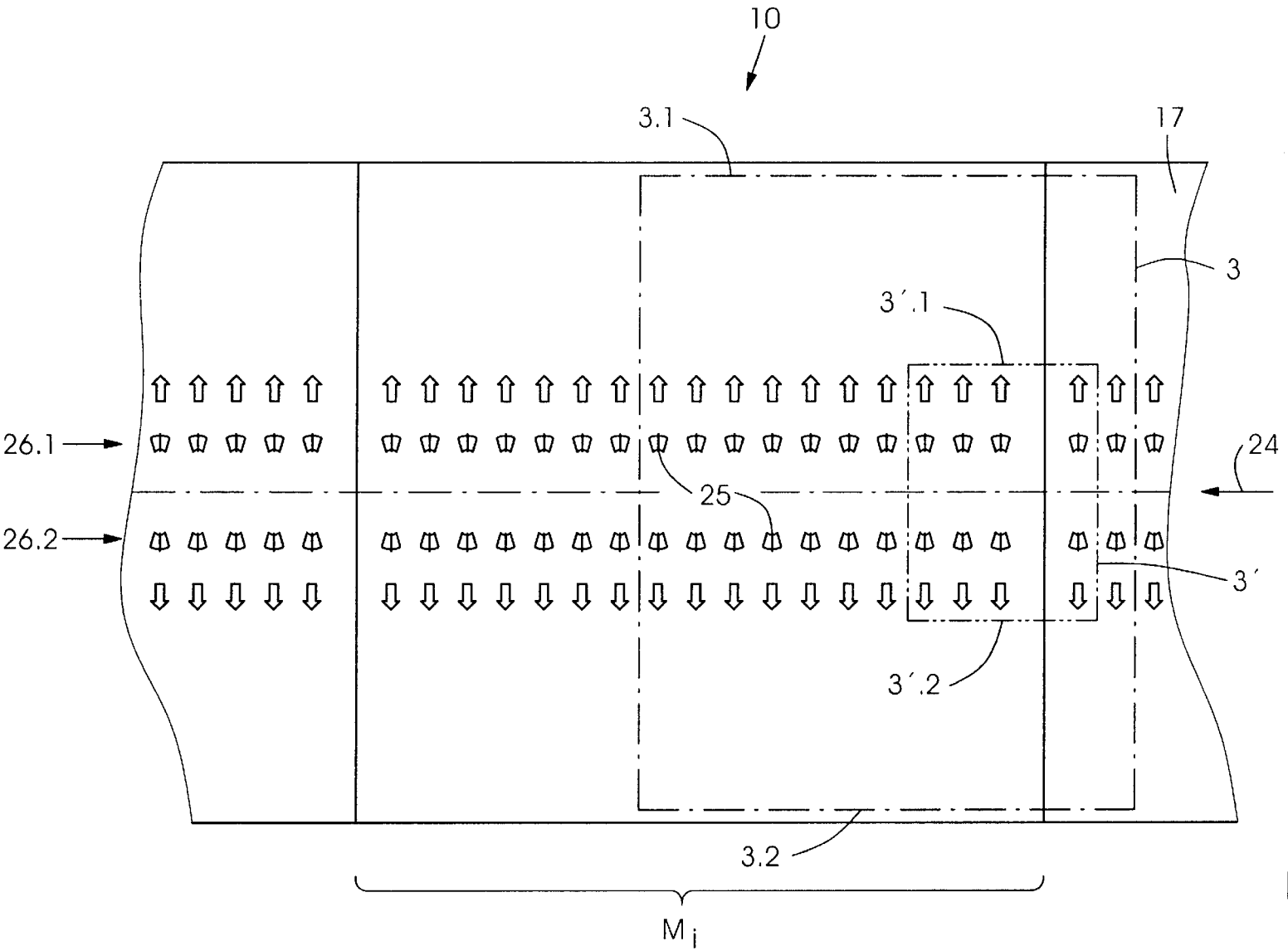
FIG. 2 is an enlarged fragmentary plan view of FIG. 1, as seen in the direction of the arrow II in FIG. 1, and showing a guide surface formed in accordance with an embodiment of the invention.

The guide surface 17 is reproduced in a top plan view in FIG. 2. Furthermore, dispensing with an illustration of the gripper systems 9, FIG. 2 reproduces, respectively, in arbitrary positions relative to the guide surface 17, a sheet 3 having a maximum processable format, the sheet being borne over the guide surface 17 by one of these gripper systems, and a corresponding sheet 3' having a considerably smaller format. In this case, one of the sheets 3, 3', respectively, may be drawn over the guide surface in a direction of travel indicated by the directional arrow 24. Nozzles 25, through which a flow passes, during operation, to form an air cushion between the guide surface 17 and one of the sheets 3 and 3', respectively, terminate in or open into the guide surface 17. The nozzles 25 are formed preferably by stamping and pressing a guide plate which forms the guide surface 17 and, on the underside thereof, non-illustrated blowing or blast air chambers provided for supplying the nozzles 25 with blowing or blast air and, preferably, the aforementioned coolant tank 23, are arranged. An advantageous embodiment of the guide plate has already been described by the applicant in Patent Application DE 199 51 894.7, to the teachings of which reference may be made here.

Advantageously, modules succeeding one another in the direction of travel, represented by the directional arrow 24, of the sheets 3 and 3' are arranged in a row which, respectively, form a section of the guide surface 17 and, as mentioned hereinbefore, are equipped with respective devices for cooling and for supplying, respectively, some of the nozzles 25 with blowing or blast air. One of the aforementioned modules is identified by M.

In order to form the guiding device 10 reproduced in FIG. 1, in particular, modules with planar portions of the guide surface 17 and modules with portions of the guide surface 17 which are curved in the direction of travel of the sheets 3 and 3', respectively, are provided. The arrangement of the nozzles 25 is adapted to different formats, ultimately processable in the printing unit 2, of the print carriers which are in the form of sheets here. In the adaptation, a respective margin of one of the print carriers, respectively, the margin being lateral with respect to the direction of travel, in the example at hand, the margins 3.1 and 3.2 of the sheet 3 and the margins 3.1 and 3.2 of the sheet 3', respectively, always lie outside the terminal regions of the nozzles 25 on the path of the print carrier along the guide surface 17, i.e., the nozzles form a matrix having corridors which are free of nozzles and which extend along the longitudinal extent of the guide surface 17. These corridors thus form, on the guide surface 17, regions wherein the guide surface 17 has a closed surface.

If the formats of the print carriers to be processed are graded appropriately, it is possible to have an arrangement of the nozzles 25 wherein they form a matrix which has a plurality of corresponding corridors on this side and that side of the longitudinal center of the guide surface 17.

In the embodiment illustrated in FIG. 2, the nozzles 25 form a matrix which lies within the extent, defined transversely to the direction of travel, of the sheet 3' having a smaller format than the largest possible processable format of the sheet 3. The nozzles 25, in this regard, are oriented in such a way that, when a flow passes through them during operation, they generate flows aligned with one of the lateral margins 3'.1 and 3'.2, respectively.

In the illustrated exemplary embodiment, the nozzles 25 form two nozzle rows 26.1 and 26.2, which are arranged along the guide surface 17, one of which, when the flow passes therethrough during operation, respectively, generates a flow oriented perpendicularly to one of the lateral margins 3.1 and 3.2, on the one hand, and 3'.1 and 3'.2, on the other hand, respectively.

A reduction of the matrix to two nozzle rows, which is performed in this manner, and the flow oriented perpendicularly to the margins 3.1 and 3.2, on the one hand, and 3'.1 and 3'.2, on the other hand, respectively, result, when the distance selected between the nozzle rows 26.1 and 26.2 is correspondingly small, in a preferred embodiment, inasmuch as print carriers of all formats from the largest processable format to the smallest format defined by the extent of the nozzle rows 26.1 and 26.2 transversely to the direction of travel can thereby be guided over the guide surface, without encroachment by the lateral margins of these print carriers on the range of influence of the terminal regions of the nozzles 25.

The nozzles 25 of each of the nozzle rows 26.1 and 26.2 are preferably at the smallest possible distance from one another therewithin.

Within the scope of the invention, however, there are also nozzle embodiments and arrangements differing from those of FIG. 2, insofar as these form only one of the aforementioned matrix types and are suitable, when the flow passes through them during the operation, of forming an air cushion below sheets of all processable formats.

Instead of nozzle rows 26.1 and 26.2 formed on a module, such as, in particular, on the module $M_i$, and made up of individual nozzles 25 which, respectively, generate a fanned-out flow, in another embodiment one of these nozzle rows 26.1 and 26.2, respectively, may be replaced by one or more outflow gaps which, respectively, generate a flow aligned with the lateral margins 3.1 and 3.2, on the one hand, and 3'.1 and 3'.2, on the other hand, respectively.

In another modification, all the nozzles 25 may be arranged in the longitudinal center of the guide surface 17 and be oriented so that successive nozzles emit flows oriented transversely to the direction of travel, and directed opposite to one another.

We claim:

1. A guiding device of a machine for processing planar print carriers having formats within a range, comprising:

a guide surface;

an operatively revolving gripper system for gripping a respective leading margin of the print carriers and drawing the print carriers in a drawing direction along said guide surface;

nozzles terminating in said guide surface for conducting therethroughg during operation, air flows for forming an air cushion between said guide surface and a respective one of the print carriers; and regions with a closed surface located on said guide surface, said regions extending in the drawing direction along said guide surface and being disposed opposite a lateral margin of any one of the print carriers drawn along said guide surface and having a format within the range of formats.

2. The guiding device according to claim 1, wherein said nozzles are adapted for emitting air flows aligned with the lateral margin of the print carriers and restricted to a central region of said guide surface, said central region extending longitudinally along said guide surface and transversally to an extent smaller than the respective extent of print carriers smaller than the largest processable print carriers.

3. The guiding device according to claim 1, wherein said nozzles are adapted for emitting air flows oriented perpendicularly to the lateral margin of the print carriers.

4. The guiding device according to claim 3, wherein said central region extends transversely to an extent smaller than the respective extent of the smallest processable print carrier.

5. A machine for processing planar print carriers having formats within a range, comprising:

a guiding device having a guide surface;

an operatively revolving gripper system for gripping a respective leading margin of the print carriers and drawing the print carriers in a drawing direction along said guide surface;

nozzles terminating in said guide surface for conducting therethrough, during operation, air flows for forming an air cushion between said guide surface and a respective one of the print carriers; and regions with a closed surface located on said guide surface, said regions extending in the drawing direction along said guide surface and being disposed opposite a lateral margin of any one of the print carriers drawn along said guide surface and having a format within the range of formats.

6. A guiding device for a machine guiding planar printing sheets of differing formats processable with the machine, comprising:

a guide surface;

nozzles in said guide surface for conducting a flow of air forming an air cushion between said guide surface and a respective one of the sheets; and said guide surface having a region without any nozzles, said region being disposed opposite to a lateral margin of any one of the formats of the printing sheets processable with the machine for preventing of the margins of any one of the formats of the printing sheets processable with the machine from being influenced by underpressure from the flow of air through said nozzels.

7. The guiding device according to claim 6, wherein said nozzles are adapted for emitting air flows aligned with the lateral margin of the printing sheet and restricted to a central region of said guide surface, said central region extending longitudinally along said guide surface and transversally to an extent smaller than the respective extent of a printing sheet smaller than the largest processable printing sheet.

8. The guiding device according to claim 7, further comprising an operatively revolving gripper system for gripping a respective leading margin of the print carriers and drawing the printing sheet in a drawing direction along said guide surface.

9. The guiding device according to claim 6, wherein said nozzles are adapted for emitting air flows oriented perpendicularly to the lateral margin of the printing sheet.

10. The guiding device according to claim 9, wherein said central region extends transversely to an extent smaller than the respective extent of the smallest processable printing sheet.

* * * * *